US011647789B2

(12) United States Patent
Liu

(10) Patent No.: US 11,647,789 B2
(45) Date of Patent: May 16, 2023

(54) ATOMIZER

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 331 days.

(21) Appl. No.: 17/013,833

(22) Filed: Sep. 7, 2020

(65) Prior Publication Data

US 2021/0186107 A1 Jun. 24, 2021

(30) Foreign Application Priority Data

Dec. 23, 2019 (CN) ..... 201911344085.4
Dec. 23, 2019 (CN) ..... 201922341539.4

(51) Int. Cl.
*A24F 40/46* (2020.01)
*A24F 40/85* (2020.01)

(52) U.S. Cl.
CPC ..... *A24F 40/46* (2020.01); *A24F 40/85* (2020.01)

(58) Field of Classification Search
None
See application file for complete search history.

(56) References Cited

U.S. PATENT DOCUMENTS

2013/0078165 A1* 3/2013 Sandra ..... G01N 30/18 422/550
2017/0105453 A1* 4/2017 Li ..... C04B 38/00
2018/0035718 A1* 2/2018 Liu ..... A24F 40/485
2019/0166654 A1* 5/2019 Cheng ..... A24F 40/46
2021/0186107 A1* 6/2021 Liu ..... A24F 40/46

* cited by examiner

*Primary Examiner* — James Harvey
(74) *Attorney, Agent, or Firm* — Matthias Scholl P.C.; Matthias Scholl

(57) ABSTRACT

A heating wire assembly including a heating wire and a plurality of fixing screws configured to fix the heating wire. When in repair or maintenance, the plurality of fixing screws is screwed out from the heating wire thereby facilitating the replacement of the heating wire.

5 Claims, 3 Drawing Sheets

ATOMIZER

CROSS-REFERENCE TO RELATED APPLICATIONS

Pursuant to 35 U.S.C. § 119 and the Paris Convention Treaty, this application claims foreign priority to Chinese Patent Application No. 201911344085.4 filed Dec. 23, 2019 and to Chinese Patent Application No. 201922341539.4 filed Dec. 23, 2019. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to an atomizer.

The heating wire of a conventional atomizer is an integrated element and cannot be replaced. In addition, the conventional atomizer comprises a side wall provided with a plurality of air vents, and an annular ring which is rotatable with respect to the side wall. The annular ring comprises a plurality of air holes. Rotating the annular ring can make the plurality of air holes align with the plurality of air vents, thereby adjusting the airflow of the atomizer.

SUMMARY

The disclosure provides an atomizer comprising a heating wire and a plurality of fixing screws configured to fix the heating wire; when in repair or maintenance, the plurality of fixing screws is screwed out from the heating wire thereby facilitating the replacement of the heating wire.

The heating wire assembly further comprises a fixed seat, an insulation ring, a positive connector; the plurality of fixing screws is configured to lock a negative lead of the heating wire on the fixed base to use as a negative electrode of the heating wire; the insulating ring is installed in the fixed seat to isolate a positive lead of the heating wire thus preventing the short circuit of the fixed base; the positive connector is installed into the insulation ring for connecting the positive lead of the heating wire; the positive lead of the heating wire is locked on the positive connector by the plurality of fixing screws to use as a positive electrode of the heating wire.

The disclosure also provides an atomizer comprising the heating wire assembly.

The atomizer further comprises an airflow regulating assembly; the airflow regulating assembly comprises a rotatable ring comprising a side wall provided with a slot, and a base comprising a side wall provided with a plurality of through holes; the rotatable ring is disposed on the base; and when in use, by rotating the rotatable ring, the plurality of through holes selectively communicates with the slot thereby adjusting an airflow of the atomizer.

The plurality of through holes is circular and identical in size, and the slot is strip-shaped.

The fixed seat is disposed on a top of the base thereby preventing the falling of the rotatable ring.

The heating wire assembly of the atomizer comprises the heating wire and the plurality of fixing screws; when in repair or maintenance, the plurality of fixing screws is screwed out from the heating wire thereby facilitating the replacement of the heating wire. The atomizer comprises the airflow regulating assembly comprising the rotatable ring; and when in use, by rotating the rotatable ring, the plurality of through holes selectively communicates with the slot thereby adjusting the airflow of the atomizer.

DETAILED DESCRIPTION

To further illustrate, embodiments detailing an atomizer are described below. It should be noted that the following embodiments are intended to describe and not to limit the disclosure.

The disclosure comprises a heating wire assembly and an atomizer comprising the same.

Figure 1:
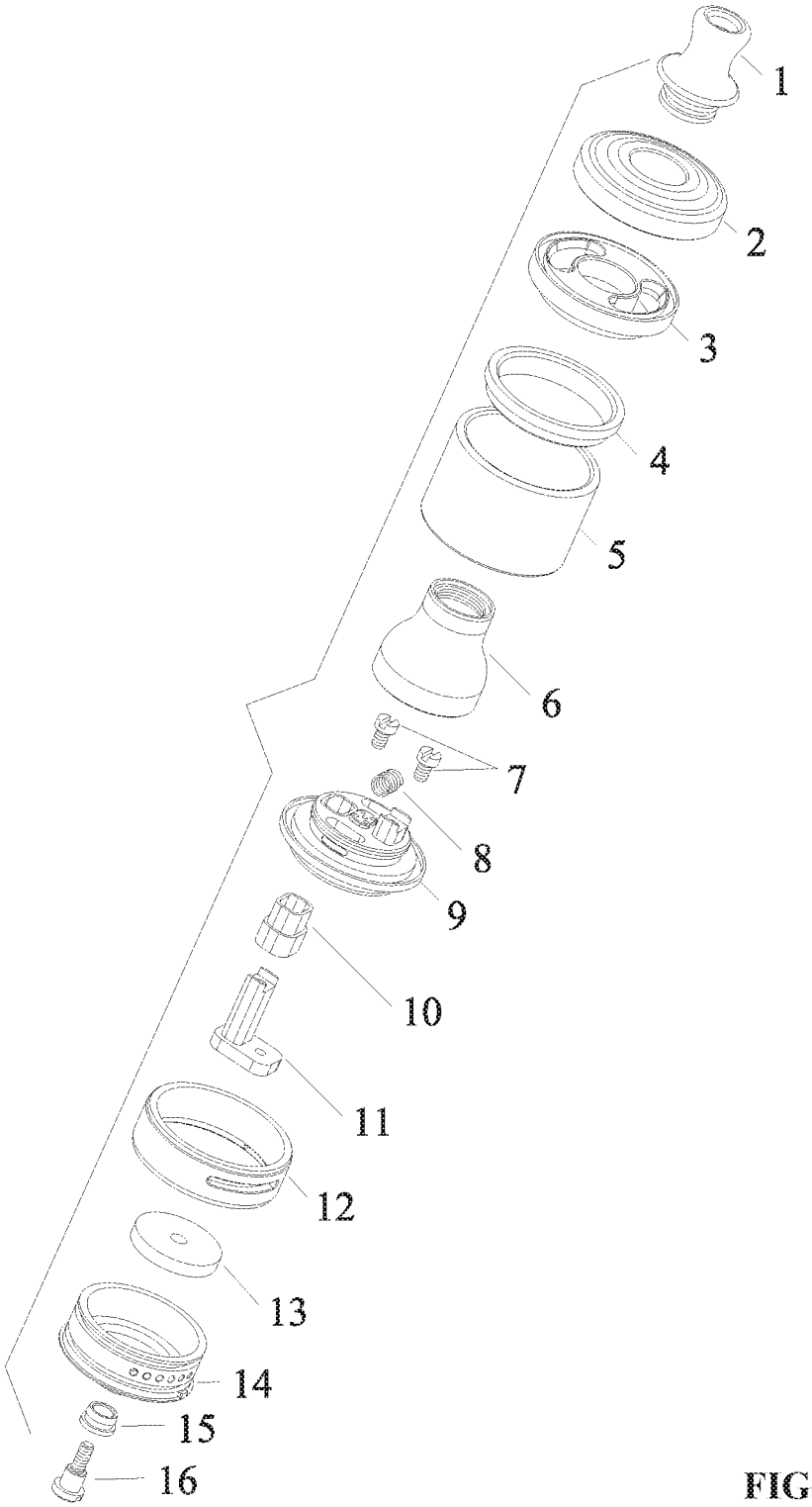
FIG. 1 is an exploded view of an atomizer according to one embodiment of the disclosure.
Figure 2:
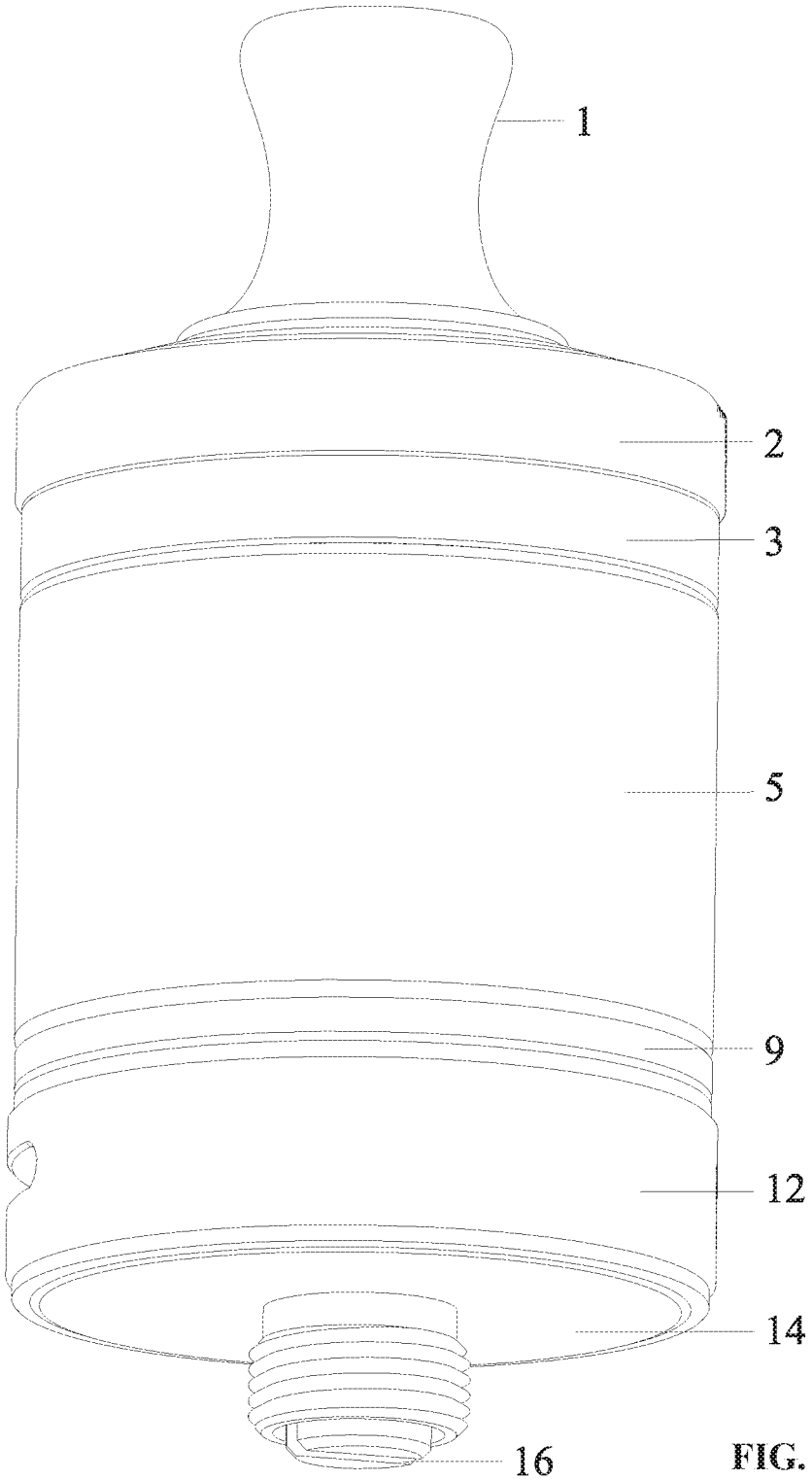
FIG. 2 is a schematic diagram of an atomizer according to one embodiment of the disclosure.
Figure 3:
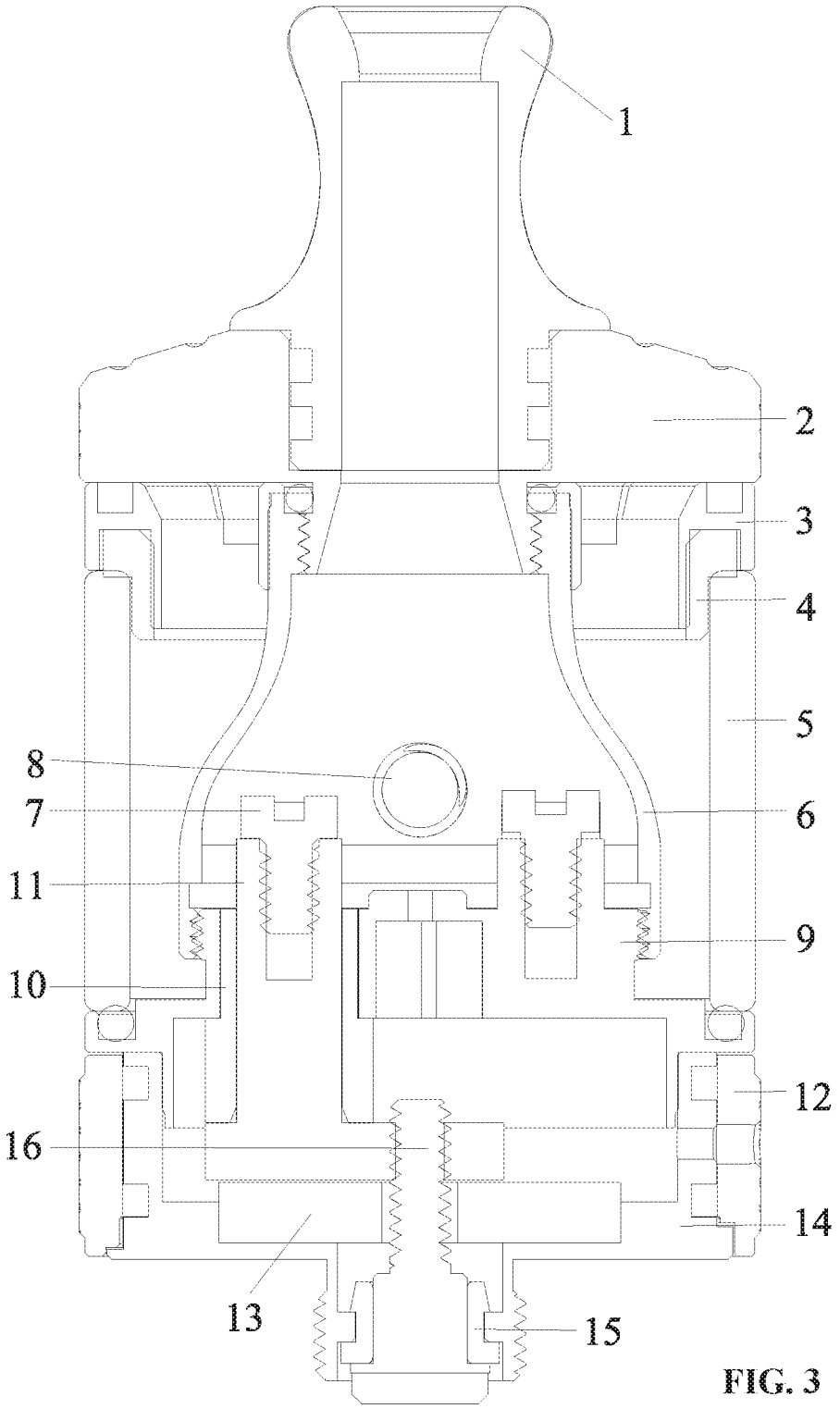
FIG. 3 is a sectional view of an atomizer according to one embodiment of the disclosure.

As shown in FIGS. 1-3, an atomizer comprises a mouthpiece 1, ahead cover 2, an e-liquid filling cover 3, a seal ring 4, a glass tube 5, a center pillar 6, a plurality of fixing screws 7, a heating wire 8, a fixed seat 9, an insulation ring 10, a positive connector 11, a rotatable ring 12, an insulating part 13, a base 14, an insulation ring 15, and an electrode 16. The mouthpiece 1 is disposed on the head cover 2. The seal ring 4 is disposed on the bottom of the e-liquid filling cover 3 and seals the opening of the glass tube 5. The e-liquid filling cover 3 is disposed on the top of the center pillar 6 and is connected to the head cover 2. The head cover 2 is disposed on the e-liquid filling cover 3 and is in threaded connection to the center pillar 6. The upper opening of the glass tube 5 is fixedly connected to the bottom of the e-liquid filling cover 3. The rotatable ring 12 is disposed on the base 14 for the airflow regulation. The insulating part 13 is disposed on the base 14 for separating the positive and negative terminals. The negative lead of the heating wire 8 is locked on the fixed base 9 through the plurality of fixing screws 7. The insulating ring 10 is installed in the fixed seat 9. The positive connector 11 is installed into the insulation ring 10. The positive lead of the heating wire 8 is locked on the positive connector 11 by the plurality of fixing screws 7. The fixed seat 9 is disposed on the base 14. The insulation ring 15 is disposed in the base for separating the electrode 16. The electrode 16 passes through the insulation ring 15 and is in threaded connection to the positive connector 11. The fixed seat 9 is disposed on the bottom of the glass tube 5 and is in threaded connection to the center pillar 6.

The following advantages are associated with the atomizer of the disclosure.

1. The atomizer comprises the airflow regulating assembly comprising the rotatable ring. The rotatable ring comprises a side wall provided with a slot, and the base comprises a side wall provided with a plurality of through holes; the rotatable ring is disposed on the base; and when in use, by rotating the rotatable ring, the plurality of through holes selectively communicates with the slot thereby adjusting the airflow of the atomizer.

2. The heating wire assembly of the atomizer comprises the heating wire and the plurality of fixing screws; when in use, the plurality of fixing screws is screwed out from the heating wire thereby facilitating the replacement of the heating wire.

It will be obvious to those skilled in the art that changes and modifications may be made, and therefore, the aim in the appended claims is to cover all such changes and modifications.

What is claimed is:

1. A heating wire assembly, comprising a heating wire, a plurality of fixing screws configured to fix the heating wire, a fixed seat, an insulation ring, and a positive connector; wherein the insulating ring is installed in the fixed seat thus preventing the short circuit of the fixed seat; the positive connector is installed into the insulation ring.

2. An atomizer, comprising the heating wire assembly of claim 1.

3. The atomizer of claim 2, further comprising an airflow regulating assembly; wherein the airflow regulating assembly comprises a rotatable ring comprising a side wall provided with a slot, and a base comprising a side wall provided with a plurality of through holes; the rotatable ring is disposed on the base; and when in use, by rotating the rotatable ring, the plurality of through holes selectively communicates with the slot thereby adjusting an airflow of the atomizer.

4. The atomizer of claim 3, wherein the plurality of through holes are circular and identical in size, and the slot is strip-shaped.

5. The atomizer of claim 4, wherein the fixed seat is disposed on a top of the base thereby preventing the falling of the rotatable ring.

* * * * *